US005131561A

United States Patent [19]

Casperson et al.

[11] Patent Number: 5,131,561

[45] Date of Patent: Jul. 21, 1992

[54] UNIVERSAL NAPKIN DISPENSER WITH INTERCHANGEABLE FACE PLATES

[75] Inventors: C. Patrick Casperson; Robert C. Hochtritt, both of Neenah; Christopher W. Chudek, Racine, all of Wis.

[73] Assignee: Wisconsin Tissue Mills Inc., Menasha, Wis.

[21] Appl. No.: 693,830

[22] Filed: Apr. 30, 1991

[51] Int. Cl.[5] ..... B65H 1/00

[52] U.S. Cl. ..... 221/35; 221/44; 221/45; 221/55; 221/66; 221/155

[58] Field of Search ..... 221/34, 35, 44, 45, 221/47, 55, 61, 62, 63, 155, 303, 304

[56] References Cited

U.S. PATENT DOCUMENTS

| | | | |
|---|---|---|---|
| 1,362,449 | 12/1920 | Teall | 221/45 |
| 2,434,206 | 1/1948 | Frieders | 221/35 |
| 3,028,047 | 4/1962 | Tuft | 221/44 |
| 4,289,262 | 9/1981 | Finkelstein | 221/63 |
| 4,953,747 | 9/1990 | Wenkman et al. | 221/35 |

FOREIGN PATENT DOCUMENTS

| | | | |
|---|---|---|---|
| 695150 | 9/1964 | Canada | 221/35 |

OTHER PUBLICATIONS

Brochure "Napkin Dispensing Equipment", Dixie/-Marathon Products, American Can Company, Greenwich, Conn., undated.

*Primary Examiner*—H. Grant Skaggs
*Attorney, Agent, or Firm*—Quarles & Brady

[57] ABSTRACT

A dispenser for folded paper napkins including a door hinged to an opening of a housing and a face plate detachably secured to the door. The face plate includes a dispensing opening through which napkins are withdrawn from the dispenser. The new dispenser allows the use of interchangeable face plates so that the same dispenser can be used to store various styles and/or sizes of folded paper napkins.

11 Claims, 4 Drawing Sheets

Fig. 7
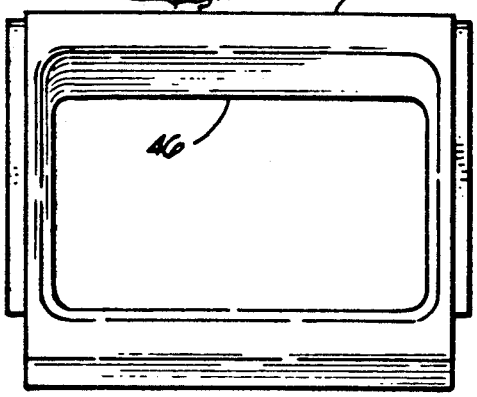
Fig. 8
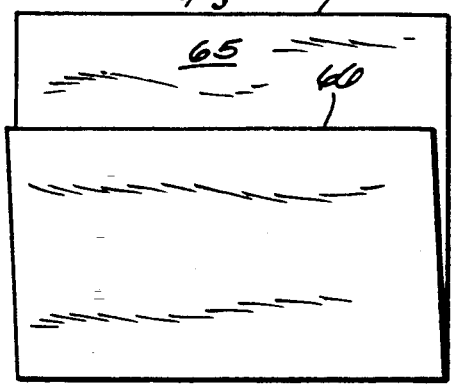
Fig. 9
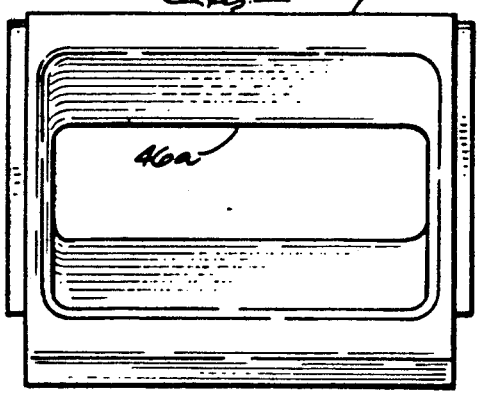
Fig. 10
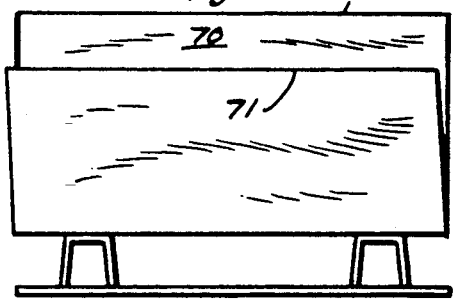
Fig. 11
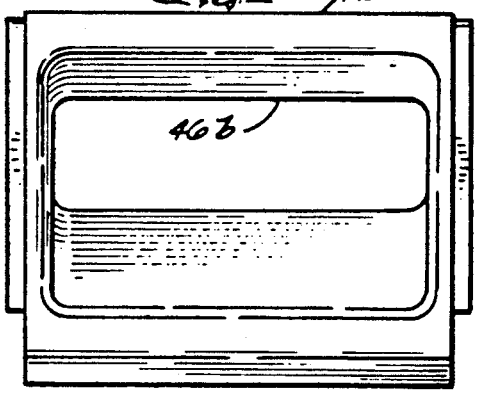
Fig. 12
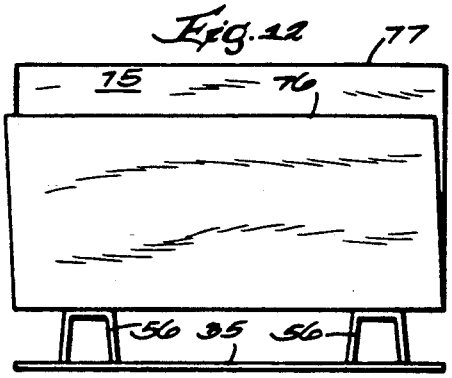
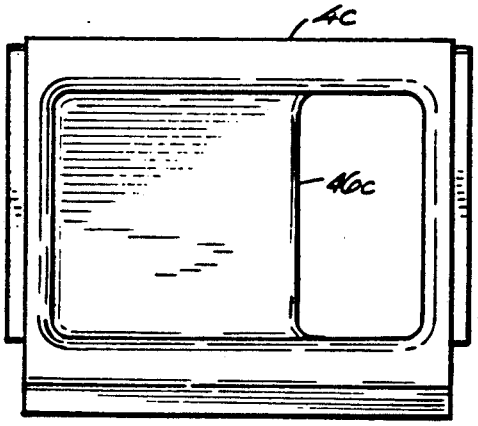
Fig. 13
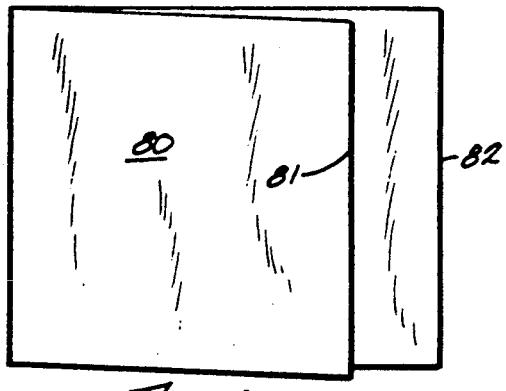
Fig. 14

UNIVERSAL NAPKIN DISPENSER WITH INTERCHANGEABLE FACE PLATES

FIELD OF THE INVENTION

The present invention relates to dispensers for folded paper napkins that are intended to store the napkins and enable withdrawal of a napkin through an opening in the dispenser.

BACKGROUND OF THE INVENTION

Paper napkins are made in a variety of sizes, depending upon the intended end use. The smallest size of unfolded napkin is often referred to in the industry as a "lip and finger" napkin and is used as an economy service representing a low cost per napkin. Typical end uses are coffee shops, donut shops, ice cream parlors, industrial cafeterias, etc. Exemplary sizes for a lip and finger napkin are 7"×13½", 7"×10" and 10"×10". An intermediate size napkin is generally referred to as a "luncheon" size napkin and represents a step up from the smaller lip and finger napkins. The luncheon size is often used in restaurant and fast food operations serving breakfast and lunch, and typically is about 12"×13", 13"×13" or 10"×17" in size. The largest paper napkin is generally referred to in the industry as a "dinner size" napkin and is used by restaurant operations that serve full meals or by those that seek to enhance the quality of service; some fast food operations also use a dinner size napkin. Exemplary dimensions of dinner size napkins include 13"×15", 13"×17" and 17"×17".

Paper napkins are often stored in a dispenser located at a convenient point of use, such as a countertop or table top. A napkin dispenser includes a compartment or enclosure in which napkins are stored until ready for use in such fashion as will cover the napkins to protect them and keep them clean and sanitary; the dispenser has an opening in at least one wall of the cabinet through which an end user can withdraw a napkin from the dispenser. The various sizes of napkins as noted above are too large to be stored in a napkin dispenser in an unfolded condition; therefore, it is necessary to fold the napkins into a smaller size for storage in a napkin dispenser. Several different sizes and styles of folded napkins are in general use in the industry, and the prior art approach in the case of napkin dispensers has been to provide a dispenser that is specifically limited to holding and dispensing a single type or size of folded napkin.

We have developed the present invention to provide universal napkin dispensers that are able to accommodate various sizes of folded napkins and napkins folded in various styles of folds. One of the advantages of the invention is that our new napkin dispensers provide a food service operator the opportunity to use different types and sizes of folded napkins in a single dispenser, and the freedom to change the type of folded napkin that is stored in our universal dispenser. Our new napkin dispenser is also advantageous to the manufacturer or seller of dispensers as it eliminates the need to produce a variety of dispensers in different sizes and having different styles of openings and/or carry a large inventory of various types of dispensers.

SUMMARY OF THE INVENTION

Our present invention provides a napkin dispenser comprising a housing defining an enclosure for storing folded napkins, at least one door hinged to the housing for access to the enclosure, and a face plate detachably secured to the door. The face plate includes a dispensing opening through which folded napkins stored in the dispenser can be withdrawn. Further, the face plate is readily detachable from the door so that face plates having various styles, sizes and locations of the dispensing opening can be inserted in the door. That is, our new napkin dispensers include interchangeable face plates in a hinged door to thereby permit various styles and/or sizes of folded napkins to be stored in the napkin dispenser.

A universal napkin dispenser of the foregoing construction has a significant advantage in that it allows the face plate to be readily changed to accommodate any specific style of folded napkin, and thereby provide the advantages noted above. Thus, the change to a different type of face plate can easily be made in the field if so desired. As a further important optional feature of the invention, the interchangeable face plates can be of transparent material, such as transparent plastic, to enhance the visibility of the napkins stored in the dispenser, which is of particular importance and utility when the napkins are printed with either a design or identifying information such as a restaurant logo. Another optional feature is that the napkin dispensers of the invention can be made of molded plastic material so as to thereby provide a stylish dispenser that can be economically produced and yet be sturdy enough for use in various types of food service operations. Other advantageous features of the present invention will become apparent from the detailed description which is presented below.

BRIEF DESCRIPTION OF THE DRAWINGS

The following enabling description of our invention is made by reference to the accompanying drawings illustrating two presently-preferred embodiments of our new universal napkin dispenser, in which:

FIG. 7 is a plan view of an interchangeable face plate, and FIG. 8 is a plan view of a folded napkin that can be stored in the dispensers with the face plate of FIG. 7;

FIG. 9 is a plan view of a second interchangeable face plate, and FIG. 10 is a plan view of a folded napkin that can be stored in the dispensers with the face plate of FIG. 9;

FIG. 11 is a plan view of a third interchangeable face plate, and FIG. 12 is a plan view of a folded napkin that can be stored in the dispensers with the face plate of FIG. 11; and FIG. 13 is a plan view of a fourth interchangeable face plate, and FIG. 14 is a plan view of a folded napkin that can be stored in the dispensers with the face plate of FIG. 13.

DESCRIPTION OF THE PREFERRED EMBODIMENTS

(a) FIGS. 1-5

Figure 1:
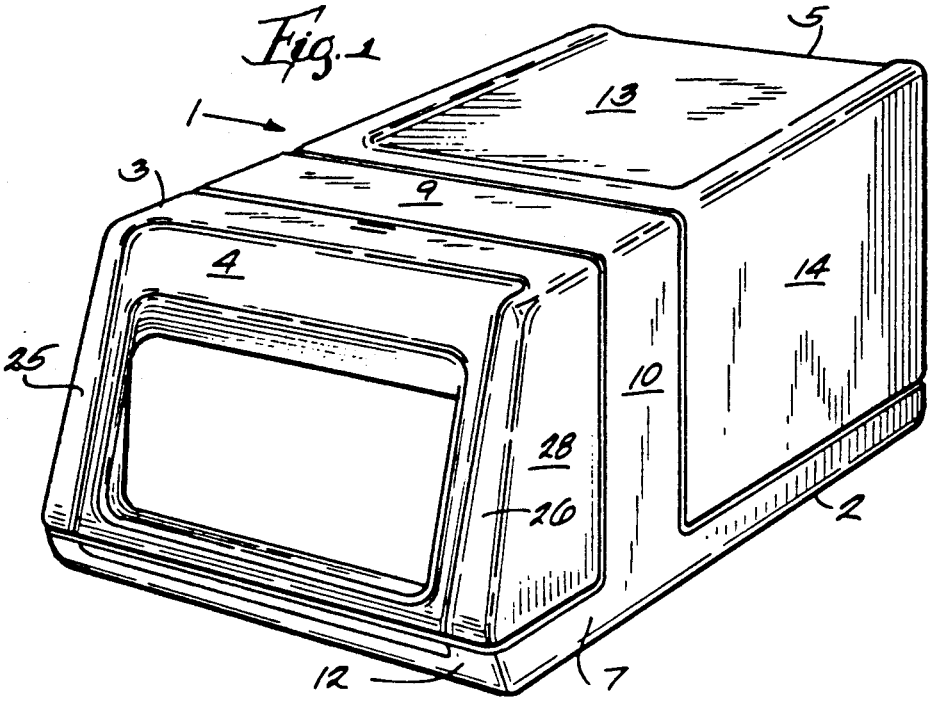
FIG. 1 is a perspective view of a first dispenser of the invention.
Figure 2:
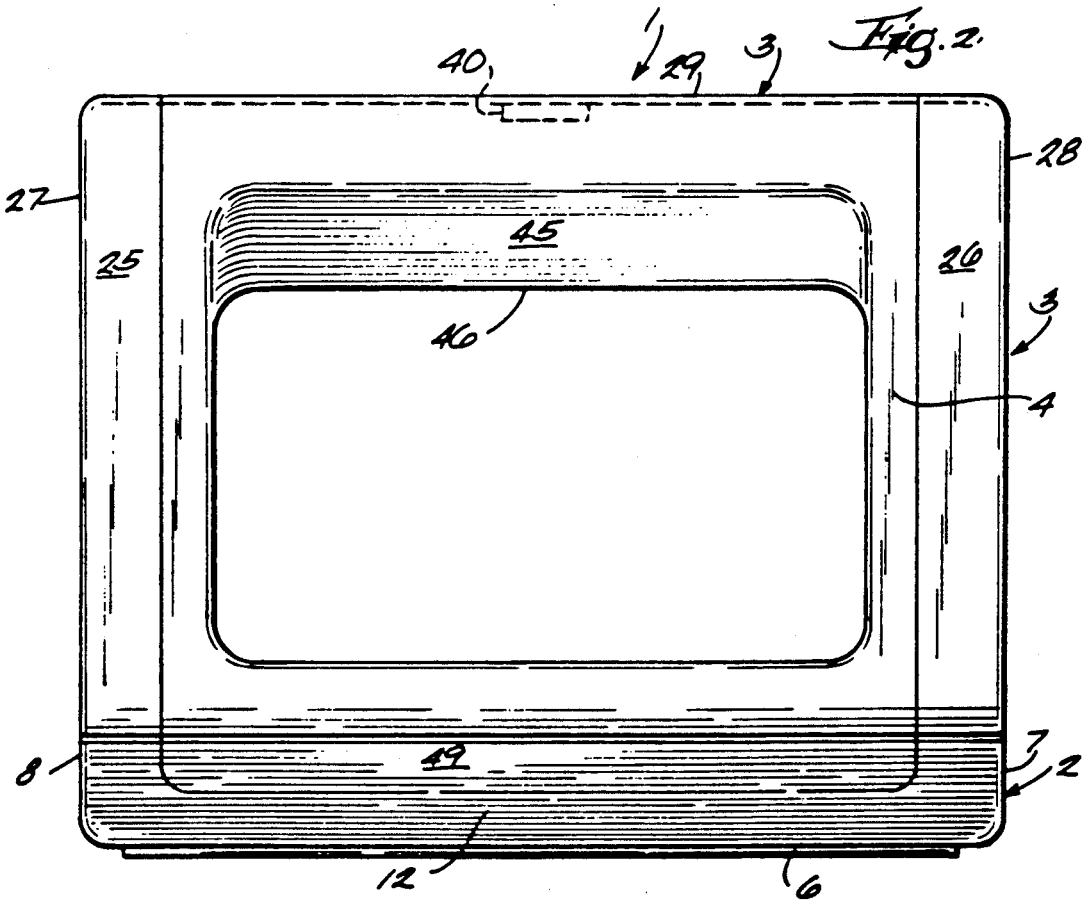
FIG. 2 is a front view of the dispenser of FIG. 1.

FIGS. 1-5 illustrate a first universal napkin dispenser 1 of the present invention. As shown in FIGS. 1 and 2, napkin dispenser 1 comprises four principle elements: a base member 2, a door 3 hinged to the front of the base member, a face plate 4 detachably secured to the door and a rear cover 5, all arranged to form a housing defining an enclosure for the storage of folded napkins.

Base member 2 of the napkin dispenser includes a bottom wall 6 (FIG. 2), short vertical side walls 7 and 8, a top wall 9 connected to side walls 6 and 7 by vertical panels 10, a short vertical back wall 11 (FIG. 5) and a short vertical front wall 12. Base member 2 is shown as a unitary molded plastic structure. Top wall 9 and panels 10 form an arch-like or frame structure extending between side walls 7 and 8 of the base member.

Figure 5:
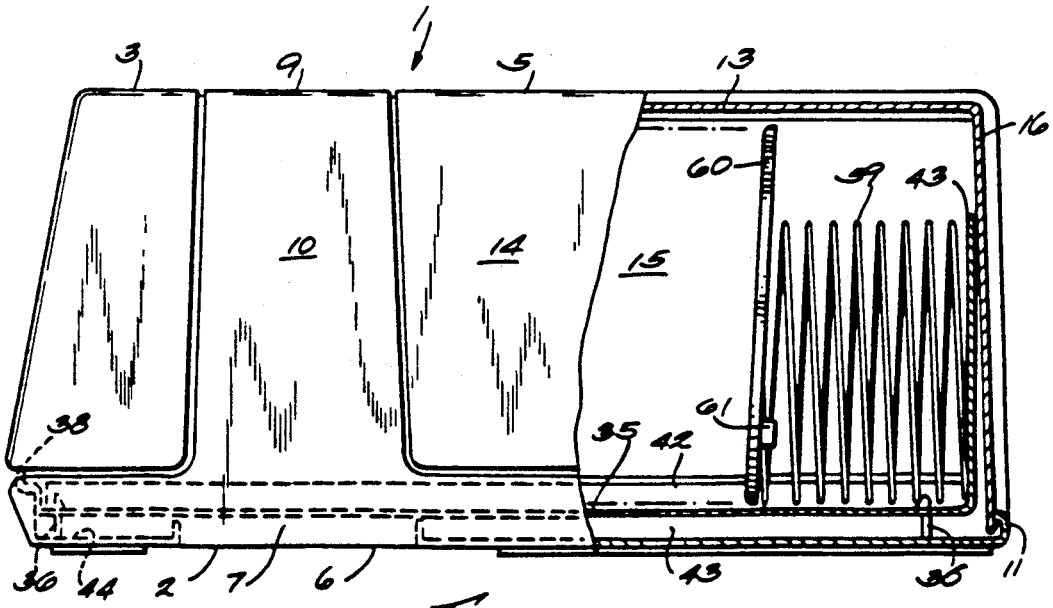
FIG. 5 is a side view with portions broken away of the dispenser of FIGS. 1–4.

Referring particularly to FIGS. 1 and 5, rear cover 5 is a unitary molded plastic structure including a top wall 13, vertical side walls 14 and 15 extending from each side of wall 13 and a rear wall 16. The forward edge of top wall 13 of the rear cover connects to the aft edge of top wall 9 of base member 2 and the lower edge of the rear wall 16 of cover 5 connects to the back wall 11 of the base member to secure rear cover 5 in the position shown in FIG. 1.

Figure 4:
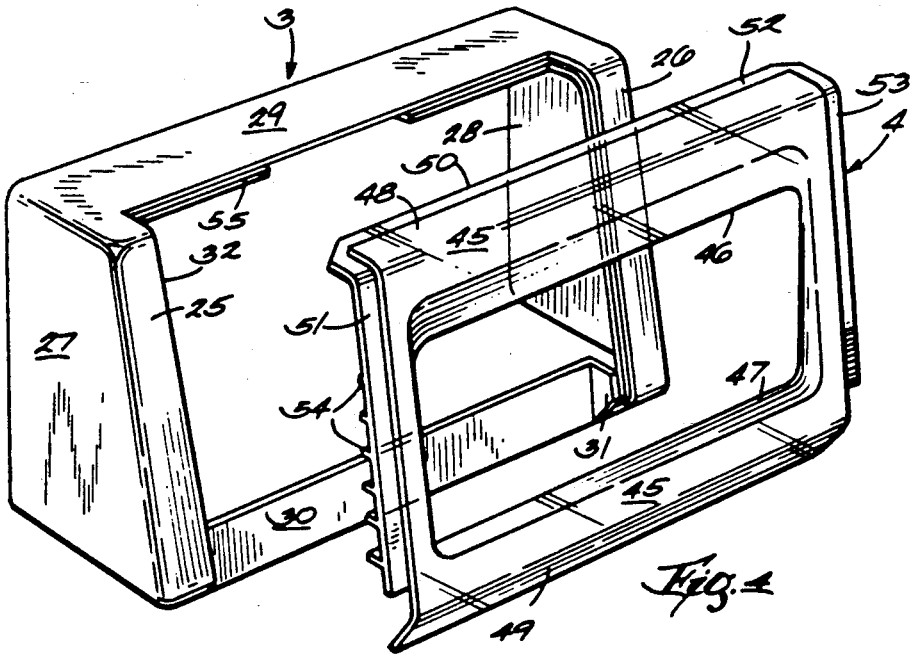
FIG. 4 is an exploded view of the door of the dispenser of FIG. 1 illustrating the interchangeability of the face plate.

As best seen in FIG. 4, door 3 of the dispenser also is a unitary molded plastic element including spaced front wall panels 25 and 26, vertical side walls 27 and 28 extending rearwardly from panels 25 and 26, respectively, a top wall panel 29, and a bottom wall panel 30 connecting the lower ends of the front wall panels. Bottom panel 30 has a rearwardly-projecting flange 31 at each end and is recessed a short distance behind front wall panels 25 and 26. Wall panels 25, 26, 29 and 30 frame or define an opening 32 in the door 3 that extends partway into top wall panel 29 of the door.

Figure 3:
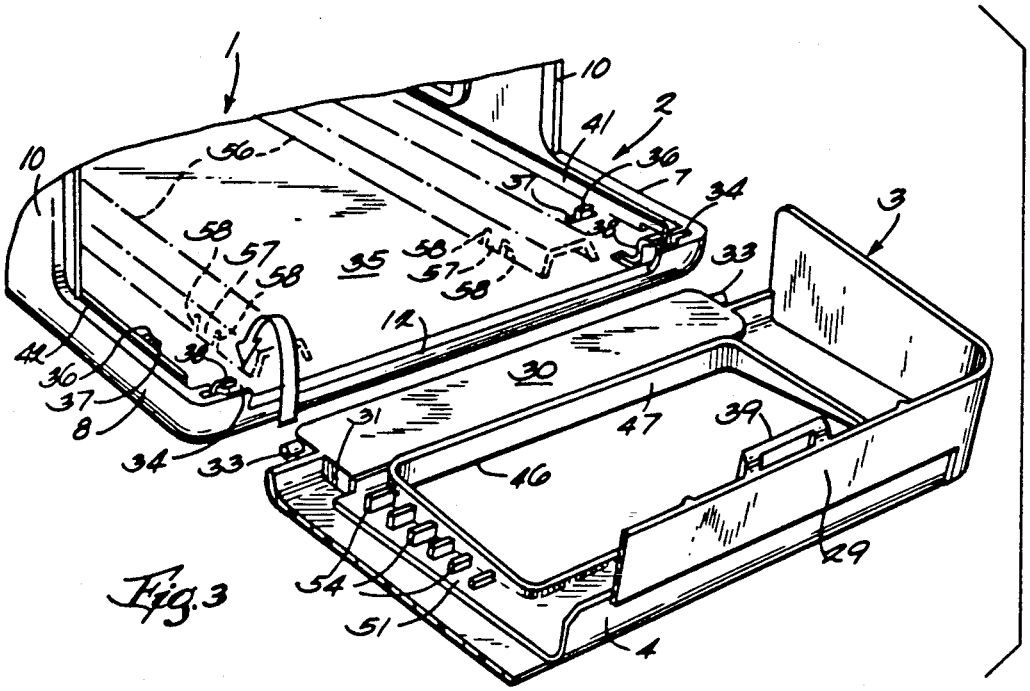
FIG. 3 is a partial perspective view, with portions broken away, of the dispenser of FIG. 1 illustrating the hinged door of the dispenser including a face plate.

FIG. 3 illustrates the manner in which door 3 is hinged to base member 2 of the dispenser. A hinge pin 33 extends from the flange 31 at each end of bottom wall panel 30 of the door, and each pin 33 fits into a channel 34 formed at the two lower front corners of front wall 12 of base member 2. A steel plate 35 snaps into position in the lower portion of base member 2 and is held in place by vertical tabs 36 molded as integral elements of the base member that lock into slots 37 formed in plate 35. The weight of steel plate 35 at the bottom of base member 2 provides added stability for the dispenser. Plate 35 also is formed to include vertical curved arms 38 that capture each hinge pin 33 of the door so as to hold each hinge pin in its respective channel 34. Door 3 can be hinged between an open position as in FIG. 3 and a closed position as in FIG. 1. The door has a hasp 39 extending from the rear edge of top wall panel 29 that engages a latch 40 (shown in dashed line in FIG. 2) molded as part of the interior surface of top wall 9 of the base member to hold the door in its closed position; the plastic material of which the door is made is slightly resilient so as to permit locking the door closed in this fashion.

As shown in FIG. 3 (but see also FIG. 5), plate 35 includes low vertical right and left side walls 41 and 42, respectively, extending longitudinally from front to back of the plate. A stack of folded napkins stored in the dispenser rests on top of plate 35, and the side walls 41 and 42 serve to guide the napkins towards door 3 as the napkins are dispensed. Plate 35 thus provides a channel-like member for controlling or guiding a stack of napkins inside the dispenser. Turning to FIG. 5, plate 35 rests on ribs 43 and 44 that extend vertically from the inside surface of bottom wall 12 of base member 2 when in its installed position.

The structure of face plate 4 is best illustrated in FIGS. 3 and 4, and the following description is made by reference to these two drawings. The face plate includes a front panel 45 that has a dispensing opening 46 which may, as illustrated, be surrounded by a cowl 47 extending inwardly of the dispenser about the periphery of the opening to provide rigidity and strength about the opening. The sides of the cowl may be tapered as shown in FIG. 4, depending upon the particular visual effect desired. A top panel 48 of the face plate extends from front panel 45 which will cover the portion of opening 32 that extends into top wall panel 29 of door 3 when the face plate is inserted in the door. A skirt panel 49 extends rearwardly from the bottom of front panel 45 and will cover bottom wall panel 30 of the door when the face plate is inserted in position. The two side portions and top portion of front panel 45 are surrounded by a three-legged inner flange 50 that includes side leg 51, top leg 52 and side leg 53. As best seen in FIG. 3, ribs 54 can be formed along the interior of each side leg 51 and 53 of the flange 50 that extend to adjacent side portions of cowl 47 to add strength to the face plate and faciliate easier dispensing of napkins.

Face plate 4 is inserted into opening 32 of door 3 from the inside of the door by first inserting skirt panel 49 of the face plate through the bottom of opening 32 so as to be positioned over the front of bottom panel 30 of the door and then pressing side legs 51 and 53 and top leg 52 of flange 50 into position along the interior surfaces of front wall panels 25 and 26 and top wall panel 29 of the door. This action is easily accomplished manually without the need for any tools due to the slight resiliency inherent with molded plastic materials. The flange 50 thereby fits along the interior surface of the specified wall panels of the door and the face plate is firmly held in the desired position. Face plate 4 is shown in FIG. 3 as being fully installed in the door. Removal of the face plate also is easily accomplished merely by reversing the installation steps. The illustrated construction thereby provides facile installation and removal of a face plate which, in turn, results in face plates that are detachably attached to the door and can be easily interchanged when desired. However, structures other than the flange 50 and related structure illustrated in the specific embodiment can be devised to provide for convenient interchangeability of face plates in the door. When face plate 4 is in position, the inner edges of panels 51-53 engage a narrow ledge 55 that extends about front wall panels 25 and 26 and top wall 29 along opening 32 of the door.

Sometimes, however, a napkin will be of such size when folded as to be too short to be reached through the dispensing opening 46 of a face plate. Referring now to FIG. 3, an optional feature of the dispensers of the present invention is the use of a pair of spaced risers 56 (shown in dashed line in FIG. 3) that can be snapped into position on metal plate 35 when needed for a particular size of folded napkin. Each riser 56 includes a plurality (4 in a prototype dispenser) of spaced fingers 57 separated from the main body of the riser by a slot 58 on each side of the finger. Metal plate 35 includes an aperture (not shown) to receive each finger 57 and hold a riser in the selected position. The risers are made of molded plastic which is sufficiently resilient to permit facile insertion of a finger 57 in an aperture of plate 35 when it is desired to use the risers, and also permit easy removal of the risers when no longer needed such as when a different size of folded napkin is stored in the dispenser.

Folded napkins are stored in the dispenser 1 by loading them through the open door 3 into the housing formed by base member and rear cover. Referring now to FIG. 5, metal plate 35 includes a vertical wall 43 at its aft end. A coil spring 59 is attached to wall 43 by any suitable means and a pressure plate 60 is attached to the front end of spring 59 by any appropriate means. For example, tabs 61 extend rearwardly from pressure plate 60 to retain the front end of coil 59 in place. Pressure plate 60 slides along plate 35 between side walls 41, 42 of the plate and is biased towards door 3 by the action of coil spring 59 to engage the back of a stack of folded napkins in the compartment so as to urge them towards door 3 to be located at a position in which an individual napkin can be easily reached by a user through dispensing opening 46 in face plate 4. Also, pressure plate 60 includes notches (not shown) to clear risers 56, when used, so as to permit sliding movement of pressure plate 60 along plate 35.

As indicated in FIG. 4, an especially useful construction is provided when a face plate 4 is made of transparent plastic material as this feature enables the napkins stored in dispenser 1 to be fully visible to the end user. That is, the portions of front panel 45 of the face plate that surround dispenser opening 46 enable the user to see any design, logo or other information that may be printed on the napkin stored in the dispenser when the face plate is transparent.

As noted previously in this description, paper napkins are made in various sizes and are folded in various styles and sizes for loading into a dispenser. An important feature of the napkin dispensers of the invention is that the face plates can have a dispensing opening of a size and position appropriate to any specific folded napkin structure, and the face plates are detachably secured to the door of the dispenser to be readily interchangeable; thus, a set of face plates can be provided with a dispenser so that the size and style of folded napkins stored in it can be readily changed when desired.

Napkin dispenser 1 is made of a size such as to have interior dimensions for an enclosure in which napkins will be stored that will accommodate various sizes of folded napkins. For this purpose, a dispenser with interior dimensions between the top surface of metal plate 25 and the interior surfaces of the side and top walls in the range of about 5 to 5.5 inches high and 7 to 7.5 inches wide is suitable for accommodating luncheon, dinner and lip and finger sizes of napkins; the dispenser can be made long enough to accommodate any selected maximum number of folded napkins when fully loaded.

Figure 6:
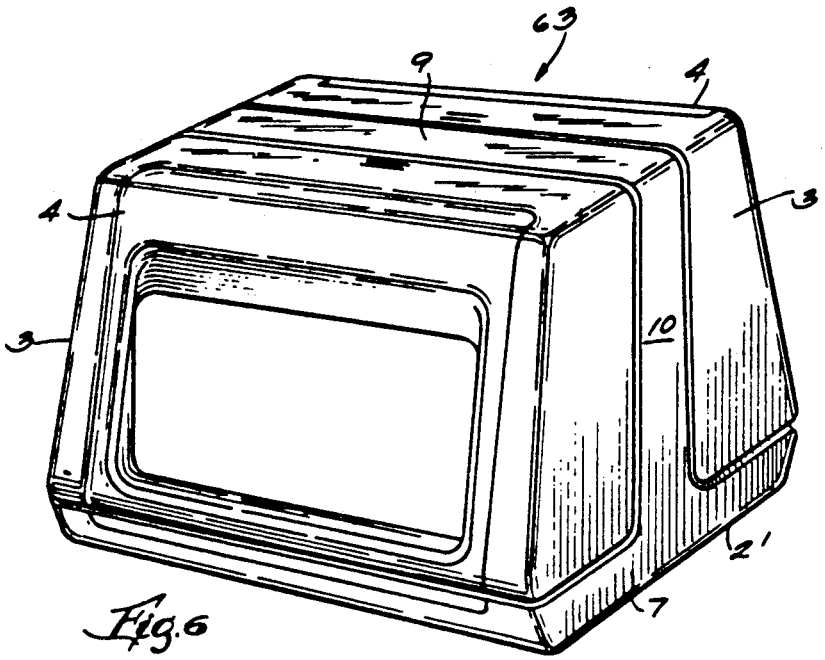
FIG. 6 is a perspective view of a second napkin dispenser of the invention.

(b) FIG. 6

Dispenser 1 illustrated in FIGS. 1-5 has a long storage area to hold a large number of folded napkins to be suitable for high volume food operations such as a cafeteria. FIG. 6 illustrates a second universal napkin dispenser according to the present invention that is smaller in size than dispenser 1 and intended principally for tabletop or countertop use.

Dispenser 63 of FIG. 6 includes a door 3 at its front end and a second door 3 at its back end, with both doors hinged to base member 2'. Base member 2' is the same structurally as base member 2 of dispenser 1 described above except that it is shorter front to back than base member 2. Also, dispenser 63 does not include rear cover 5 of dispenser 1. Each door 3 is hinged to base member 2' in the same manner described previously in connection with FIGS. 1-5. A face plate 4 is detachably secured to each door, also as described previously, such as by snapping a face plate into a door. A dual action pressure plate means, not shown, can be employed with dispenser 63 comprising a U-shaped central member of spring steel that is attached to the interior surface of top wall 9 of the dispenser. A pressure plate is attached to each end of the central member, one plate being biased towards the door at one end of the dispenser and the other plate being biased towards the door at the opposite end of the dispenser. The structural elements of dispenser 63 most usefully are of molded plastic, with the face plates molded of transparent plastic. Elements of dispenser 63 not specifically described are the same as corresponding elements of dispenser 1.

Dispenser 63 is particularly adapted for tabletop and countertop use since it is of a smaller size than dispenser 1; also, however, having folded napkins stored in the dispenser accessible from both the front and back ends results in a dispenser that is especially convenient since persons at different positions around a table can readily remove a napkin from the dispenser.

(c) FIGS. 7-14

Several exemplary forms of interchangeable face plates and a style of folded napkin that each face plate can accommodate are illustrated, which can be employed with either dispenser 1 or dispenser 63. The napkins are drawn slightly unfolded to more clearly illustrate their structure, it being understood they are folded flat.

Face plate 4 of FIGS. 1-6 is illustrated in front view in FIG. 7. Face plate 4 includes a rather large size horizontal dispenser opening 46 that, in a prototype dispenser, was approximately 3.1 inches high by 5.5 inches wide. FIG. 8 illustrates folded napkin 65 that can be stored in dispenser 1 or 63 when face plate 4 is installed in door 3. Napkin 65 is a 13"×17" dinner size napkin folded in quarters and then folded again to provide a folded napkin about 4.5" high and 6.5" long having a horizontal tab 66 positioned about 1.5 inches below the top edge 67 of the folded napkin. When a stack of napkins 65 is loaded into the dispenser, the napkins rest on metal plate 35 and tab 66 is located within dispenser opening 46 to be accessible by a user.

FIG. 9 illustrates a second face plate 4a that has a medium size horizontal dispenser opening 46a which is about 5.5" long and 1.6" high and approximately centered on the face plate. FIG. 10 shows folded napkin 70 that is a 13" by 13" luncheon size napkin which has been folded in quarters and then folded again to about 3.7" high and 6.5" long with a horizontal tab 71 positioned about 1" below the top edge 72 of the folded napkin. Tab 71 is positioned within dispenser opening 46a when a stack of napkins 70 is loaded into the dispenser, and is thereby available to be grasped by a user to pull a napkin 70 from the dispenser. The risers 56 can be installed on metal plate 35 to insure that tab 71 is within opening 46a of face plate 4a.

FIG. 11 shows a third face plate 4b that has a horizontal dispenser opening 46b of the same size as opening 46a of face plate 4a but which is located at a higher position along face plate 4b, approximately above center of the face plate. A folded napkin 75 is shown in FIG. 12 which is a lip and finger napkin about 13"×15" which is folded three times along its long dimension and then folded in half so as to provide a folded napkin about 4.5" high and 6.5" long that includes a tab 76 located about 1.5" below top edge 77 of the folded napkin. The risers 56 are employed to elevate the stack of folded napkins 75 to the appropriate height in the dispenser, each with its tab 76 positioned within dispenser opening 46b to be available for withdrawing a napkin from the dispenser.

FIG. 13 illustrates a fourth face plate 4c that has a vertical dispenser opening 46c located near one end of the face plate which is about 3.4" high and 1.8" wide. Folded napkin 80 illustrated in FIG. 14 is a 10" by 17" luncheon size napkin which is folded in half along its short dimension and then folded three times along its length to provide a folded napkin that is about 5" high by 6.3" long with a tab 81 located about 1.5 inches from its outer edge 82. A stack of folded napkins 80 is loaded into dispenser 1 or 60 with the long dimension of each folded napkin resting on metal plate 35 at the bottom of the dispenser and the tab 81 extending vertically within dispenser opening 46c.

While FIGS. 7–14 illustrate four different styles of face plates and four different styles of folded napkins that can be accommodated by the face plates, other sizes and styles of folded napkins can be stored in a dispenser with the illustrated face plates; also, napkin dispensers of the invention can be made with face plates having dispenser openings that differ with respect to shape, size and/or location than as shown with face plates 4–4c.

There has thus been described two exemplary forms of a new dispenser for folded paper napkins, each including a housing formed of walls defining an enclosure for storing the napkins. The housing includes one or more open ends, and a door is hinged to the housing along each open end, with the door(s) comprising wall panels defining an opening. Further, a face plate is detachably inserted in the opening in a door and has a dispensing opening of a size, location and shape suitable for withdrawal of one or more styles of folded napkins; face plates are readily interchangeable so that a different face plate can be easily inserted into the door to accommodate other styles of folded napkins in a single universal dispenser. The dispenser of the invention has been fully and completely described with respect to two exemplary embodiments, but it is anticipated that those skilled in the art will be able to devise changes to the described embodiments that will remain within the spirit and scope of the present invention.

We claim:

1. A dispenser for folded paper napkins comprising:

a housing enclosing at least part of a storage area for folded paper napkins, the housing having an opening towards at least one end;

a door that is pivotably mounted to the housing for positioning over the opening in the housing, the door including an opening and the door including wall panels having a plurality of edges along a periphery of the opening in the door, the wall panel forming a plurality of surfaces facing inwardly towards the storage area for folded paper napkins; and a face plate mounted to project through the opening in the door from inside the door, the face plate including a dispensing opening smaller than the opening in the door for withdrawal of folded napkins from the storage area, the face plate including top and side portions which are non-overlapping in front of the wall panels adjacent the periphery of the opening in the door and the face plate including structure positionable behind the door opening for cooperating with the edges and with the inwardly facing surfaces of the wall panels of the door for snap-fit mounting and detachment of the face plate into the door from behind the door opening.

2. A dispenser according to claim 1 further characterized in that:

the face plate structure includes peripheral flange means for engagement with inner surfaces of the wall panels of the door to detachably secure the face plate to the door.

3. A dispenser according to claim 1 further characterized in that:

the door is movable between (a) an open position to provide access to the enclosure for loading napkins in the enclosure, and (b) a closed position for withdrawal of napkins from the enclosure; and the dispenser includes latch means for retaining the door in its closed position.

4. A dispenser according to claim 1 further characterized in that:

the door includes hinge pin means along a lower portion thereof, and the housing includes channel means for receiving the hinge pin means.

5. A dispenser according to any one of claims 1–4 further characterized in that:

the face plate is transparent.

6. The dispenser of claim 1, further comprising:

a second face plate including a dispensing opening of different shape than the dispensing opening of the earlier mentioned face plate, and wherein the second face plate includes portions identical to the non-overlapping portions on the earlier mentioned face plate and structure positionable behind the door opening for snap-fitting the second face plate into and out of position from behind the opening in the door.

7. A dispenser for folded paper napkins comprising:

a housing enclosing at least part of a storage area for folded paper napkins, the housing having openings towards opposite ends;

a pair of doors, each pivotably mounted to the housing for positioning over a respective opening of the housing each door including an opening and each door including wall panels having a plurality of edges along a periphery of the opening in the respective door, the wall panels for each door forming a plurality of surfaces facing inwardly towards the storage area for folded paper napkins; and face plates mounted to project through the respective door openings from inside the respective doors, each face plate including a dispensing opening smaller than the opening in the door for withdrawal of folded napkins from the storage area, the face plate including top and side portions which are non-overlapping in front of the wall panels adjacent the periphery of the opening in the door and the face plate including structure positionable behind the door opening for cooperating with the edges and with the inwardly facing surfaces of the wall panels of the door for snap-fit mounting and detachment of the face plate into the door from behind the door opening.

8. A dispenser according to claim 7 further characterized in that:

each face plate structure includes peripheral flange means for engagement with inner surfaces of the wall panels of its respective door to detachably secure the face plate to the door.

9. A dispenser according to claim 7 further characterized in that:

each door is movable between (a) an open position to provide access to the enclosure for loading napkins in the enclosure, and (b) a closed position for withdrawal of napkins from the enclosure; and the dispenser includes latch means for retaining each door in its closed position.

10. A dispenser according to claim 7 further characterized in that:

each door includes hinge pin means along a lower portion thereof, and the housing includes channel means along each open end thereof for receiving the hinge pin means of one of the doors.

11. A dispenser according to any one of claims 7–10 further characterized in that:

both face plates are transparent.

* * * * *